US012582247B2

(12) United States Patent
McHenry et al.

(10) Patent No.: US 12,582,247 B2
(45) Date of Patent: Mar. 24, 2026

(54) MAGNETIC PICTURE FRAME SYSTEM

(71) Applicants: Lindsay Nicole McHenry, St. Henry, OH (US); Jonathan Michael Ranly, St. Henry, OH (US)

(72) Inventors: Lindsay Nicole McHenry, St. Henry, OH (US); Jonathan Michael Ranly, St. Henry, OH (US)

( * ) Notice: Subject to any disclaimer, the term of this patent is extended or adjusted under 35 U.S.C. 154(b) by 175 days.

(21) Appl. No.: 18/528,950

(22) Filed: Dec. 5, 2023

(65) Prior Publication Data

US 2025/0176738 A1 Jun. 5, 2025

(51) Int. Cl.
*A47G 1/06* (2006.01)

(52) U.S. Cl.
CPC ..... *A47G 1/06* (2013.01); *A47G 2001/0672* (2013.01)

(58) Field of Classification Search
CPC ..... A47G 1/06; A47G 2001/0672
USPC ..... 40/124.04, 426, 600, 621, 661.01, 700, 40/711, 763, 768, 777, 790, 791, 793
See application file for complete search history.

(56) References Cited

U.S. PATENT DOCUMENTS 8,959,817 B1 * 2/2015 Barnes ..... A47G 1/06 40/711
2013/0160338 A1 * 6/2013 Forbis ..... A47G 1/0638 40/711

* cited by examiner

*Primary Examiner* — Justin V Lewis
(74) *Attorney, Agent, or Firm* — R. William Graham

(57) ABSTRACT

A picture frame system includes a frame having an inner surface with a channel, a panel having a peripheral edge which is received in the channel and defines an area A which remains exposed within the perimeter member, and at least one magnetic member attached to the panel member within area A and a substrate having an aesthetic aspect and at least one metallic magnetically attracted member on a back of the substrate oriented in a complementary manner to be magnetically held in place.

13 Claims, 5 Drawing Sheets

QUICK RELEASE TOOL EXPLODED VIEW

MAGNETIC PICTURE FRAME SYSTEM

BACKGROUND OF THE INVENTION

Field of the Invention

This invention relates generally to picture frames for pictures and art, more particularly, to picture a frame system having a magnetic backing with interchangeable art panels magnetically held within the outer frame enabling quick removal and replacement of the art panels and for displaying two and three dimensional artwork and photography.

Description of the Prior Art

Picture frames as decorative edging for a picture provide decorative and functional device to display and provide protection for the same. Myriads of various picture frame designs have been developed over the years.

One significant issue in decorating walls is the selection, orientation and color selection of the appropriate frames and sizes placed on a wall. This typically takes quite a bit of time and effort to properly coordinate a collection of frames on the wall and once done, there typically comes a time, be it a seasonal change or the desire to update a family photo, that the user is faced with having to remove the frames from the wall, and in many cases change the artwork and frame entirely to accommodate a size of the new particular art piece or photo.

Another problem which still exists with conventional picture frames is the ability to quickly change out the display of a single photo or artwork within a given frame. Typically, when it is desired to change the photo or artwork, it requires a bit of work in removal of the print from the frame or sometimes the removal and replacement of the frame itself with the new artwork/photo. Again, this can be inconvenient in the case where the frames are already chosen to match a room color, material, or design and it would be preferred to retain the original picture frame. Replacing frames as a result of the need to update a photo or artwork creates unnecessary waste and results in unusable frames that end in storage or are disposed.

Thus, there remains a need for a picture frame system which allows a user to change the artwork or photographs quickly within an existing picture frame in its disposed position, such as mounted on a wall, without having to remove the frame from its position. It would be helpful if the picture frame system additionally enabled a standardized art panel system that is quickly interchangeable in order to display the desired new items which could be a picture, photo or seasonal display item as will be discussed.

The Applicant's invention described herein provides for a magnetic customizable picture frame system adapted to allow a user to change the visibly defined inner surface area of a picture frame to receive any one of a new photograph, or seasonal object. As a result, many of the limitations imposed by prior art structures are removed.

SUMMARY OF THE INVENTION

It is an object to ease the process of changing pictures or artwork going forward in a new picture frame system.

It is another object to provide quick interchangeable panel members magnetically held within a defined inner panel region of a picture frame enabling quick removal and replacement and for displaying two and three dimensional artwork and photography.

A further object is to provide a frame system which can be fixed in a position, such mounted on a wall, and wherein the artwork and/or picture can be quickly and easily interchanged without the need for removing or disturbing the orientation of the frame(s).

Accordingly, an embodiment of the invention is directed to a novel picture frame system. The system includes one or more frames, wherein each frame has a one or more perimeter member(s) of a given thickness T and having an inner surface with a channel for receiving a panel to be received in the channel. The panel includes a magnetic member, such as a plurality of peripherally disposed magnets placed within open surfaces defined within a back of the panel of a size to preferably friction fit and glued to retain the magnets. Once the panel is fixed in the channel, the perimeter member can be equipped with conventional wall securing mechanisms as is known in the art. A front of the panel includes an area A which remains exposed within the perimeter member(s) and includes the magnets at least partially disposed behind the area A.

An aesthetic substrate, which can be a print on a foam core or plastic for example, has one or more metallic magnetically attracted member on a back of the substrate oriented in a complementary manner to be magnetically held in place by the magnets of the panel. Preferably, the aesthetic substrate can be configured substantially to span within area A to render a gapless appearance within the picture frame system.

Thus, the picture frame system has interchangeable panel members magnetically held within a defined inner panel region of the frame enabling quick removal and replacement and for displaying two and three dimensional artwork and photography. The picture frame envisions a frame having various geometric configurations, such as rectangular, annular, or polygonal shaped body.

A substrate removal tool is also available. The removal tool includes a handle member having one end equipped with a magnet, preferably having a greater magnetic force than the magnetic force of that in the panel, and upon contact with a part of the substrate having the metallic magnetically attracted member, the substrate can be quickly removed without the need of removing the frame from the wall to which it is fixed.

These and other objects will be apparent to one of skill in the art upon reading the attached description and reviewing the drawings.

DETAILED DESCRIPTION OF PREFERRED EMBODIMENTS

Figure 1:
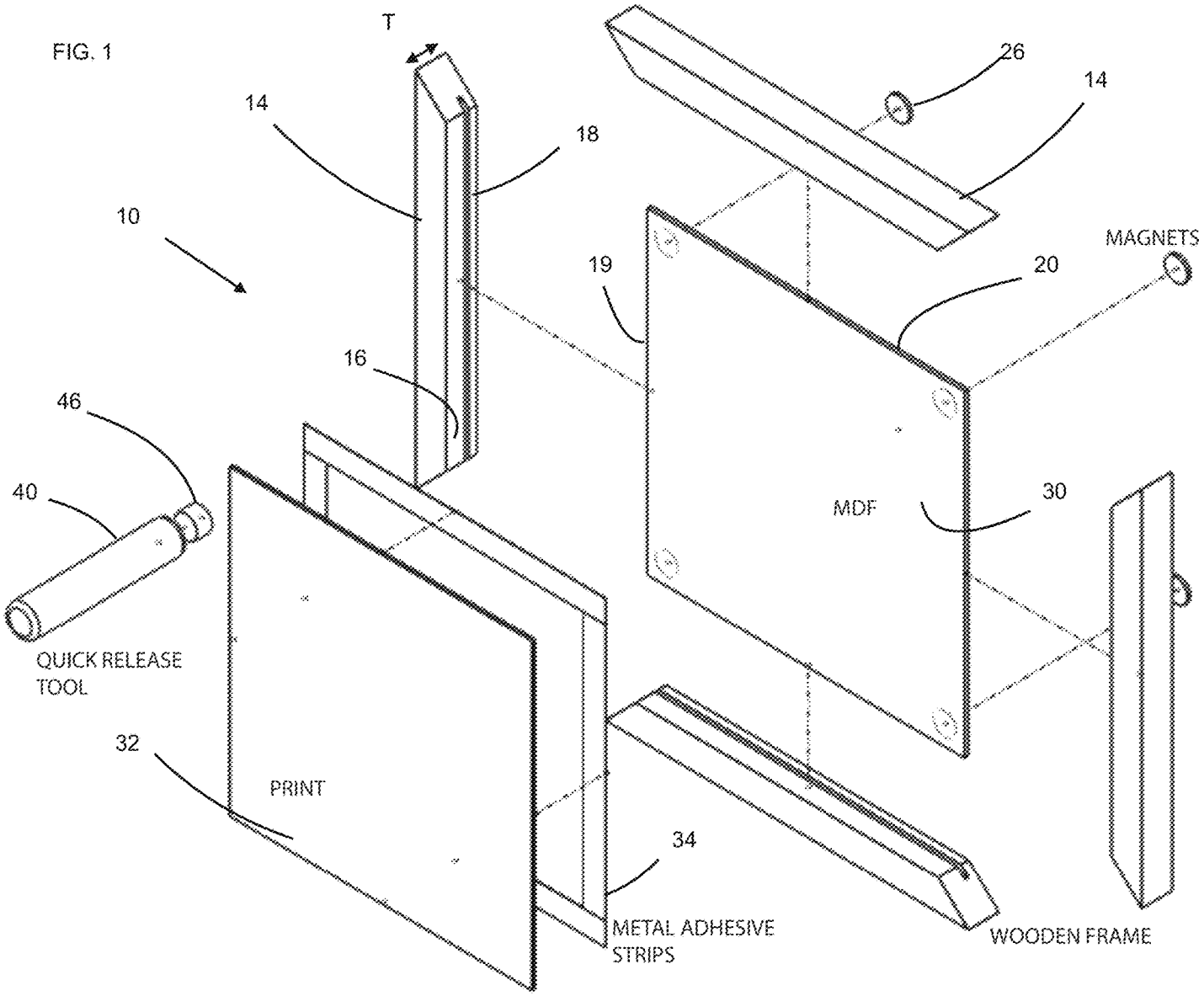
FIG. 1 depicts an exploded view of the picture frame system of the instant invention.
Figure 2:
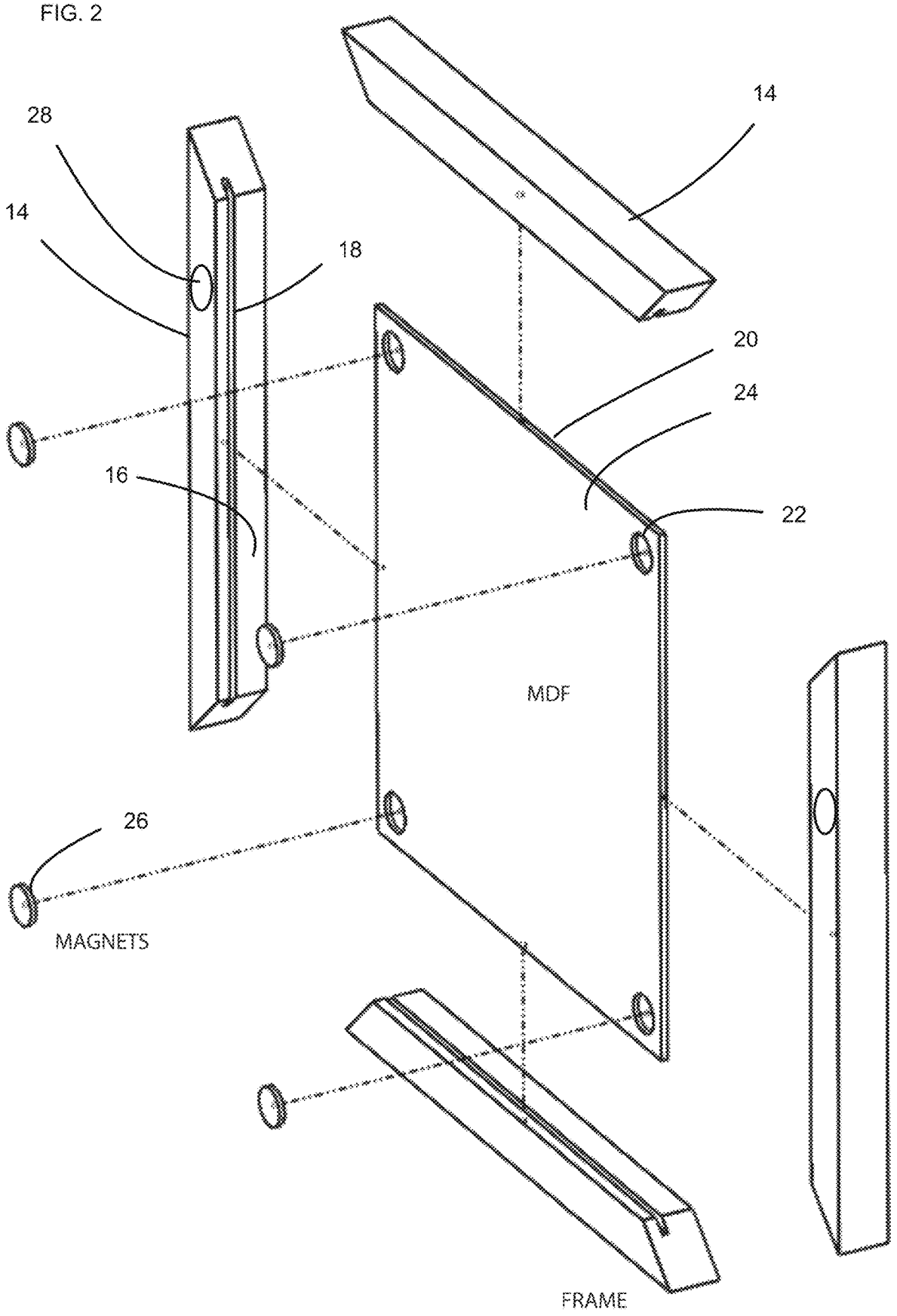
FIG. 2 depicts an exploded view of a component of the invention.
Figure 3:
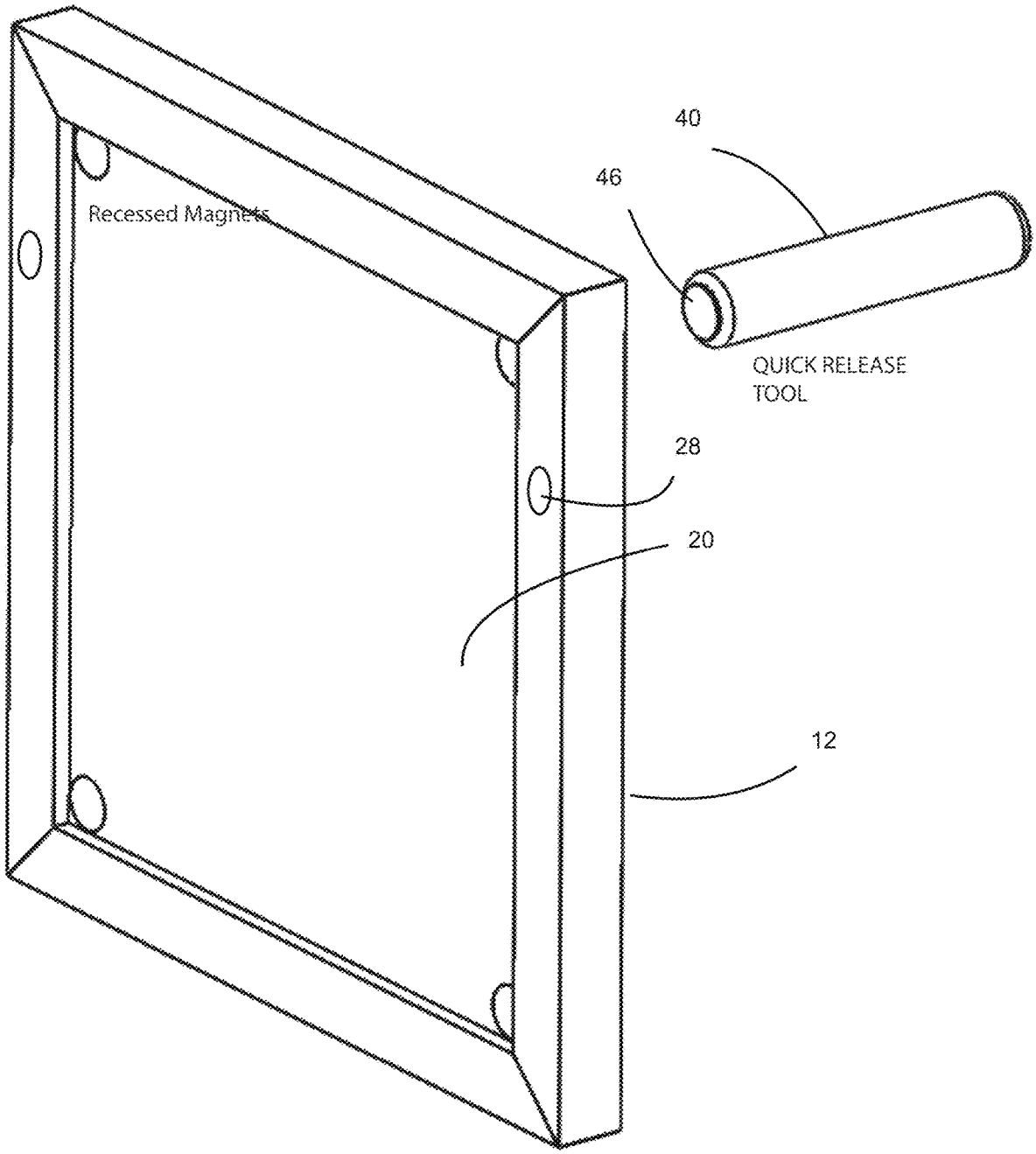
FIG. 3 depicts a back perspective of a components of the invention.
Figure 4:
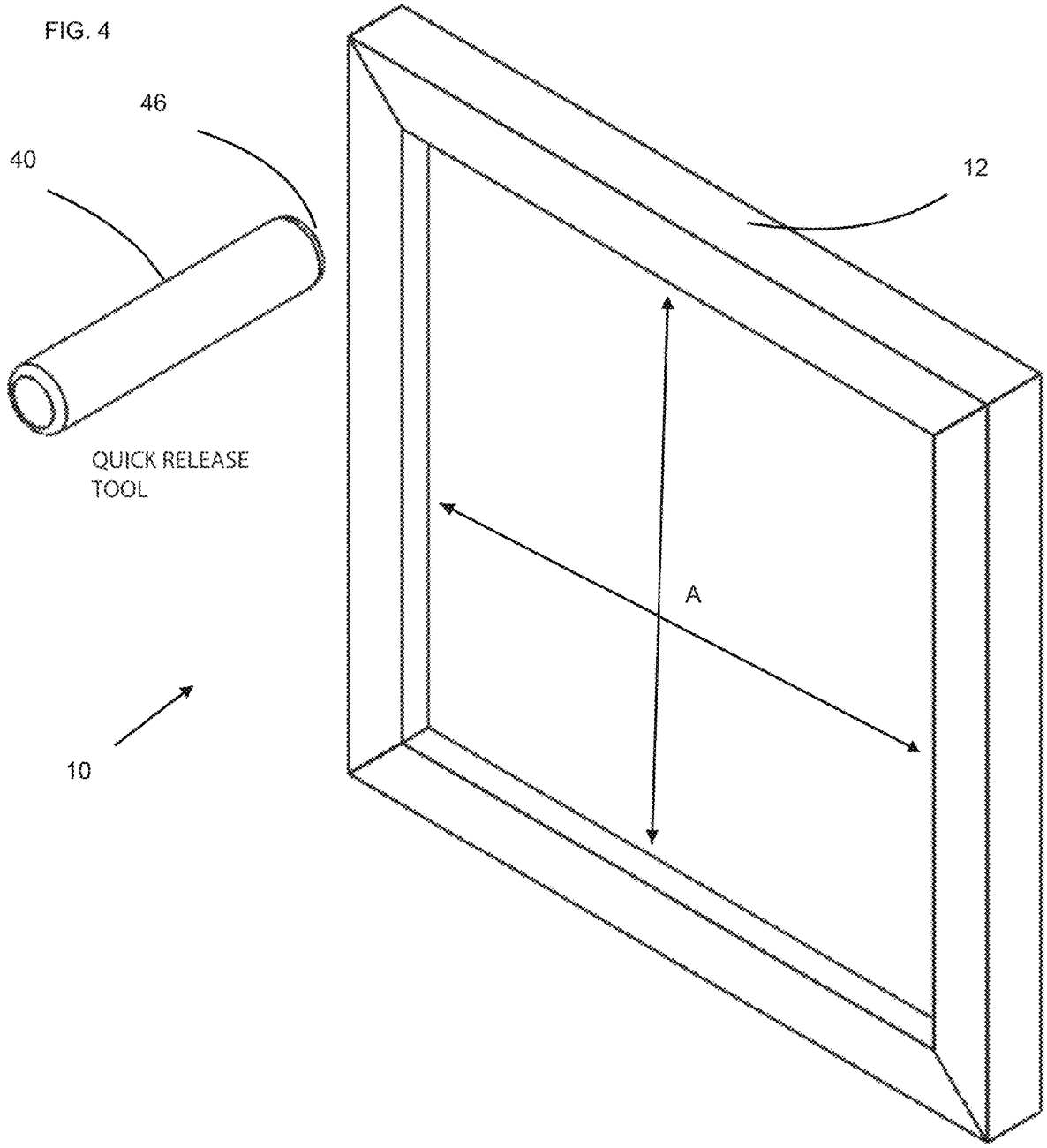
FIG. 4 depicts a front perspective of a components of the invention.

Referring now to the drawings, the present invention is directed to a novel picture frame system 10. In the preferred embodiment, the system 10 includes one or more frames 12, wherein each frame 12 has a one or more perimeter member(s) 14 of a given thickness T and each having an inner surface 16 with a channel 18 for receiving a having its peripheral edge 19 of panel 20 (or otherwise referred to herein as "panel member") to be received in the channel 18.

The panel 20 can preferably be made of relatively rigid or semi-rigid material such as Medium-Density Fiberboard (MDF) for example. The panel 20 can preferably be formed with open surfaces 22 defined within a back surface 24 of the panel 20 which are of a size to include a magnet 26. In this embodiment, there are shown a plurality of peripherally disposed magnets 26 in each corner placed within open surfaces 22 of back surface 24 of the panel and each are of a size to preferably friction fit and glued in to retain the magnet 26. Once the panel 20 is fixed in the channel 18, the perimeter member 14 can be equipped with conventional wall securing mechanisms 28 as is known in the art, i.e., hangers. A front 30 of the panel 20 includes an area A which remains exposed within the perimeter member(s) 14 and wherein the magnets 26 are at least partially, preferably entirely, disposed behind the area A.

Figure 5:
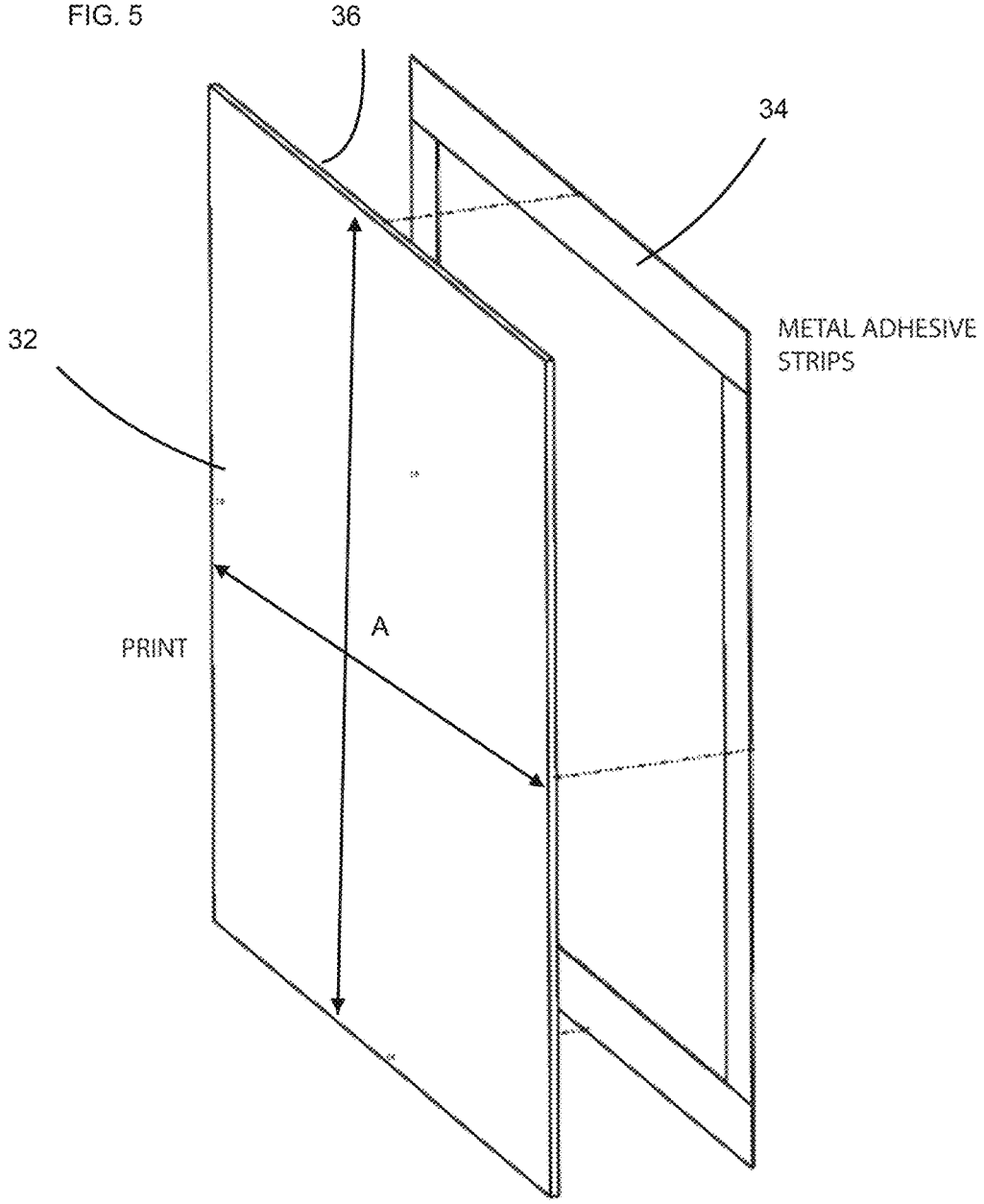
FIG. 5 depicts another front exploded of a components of the invention.
Figure 5:
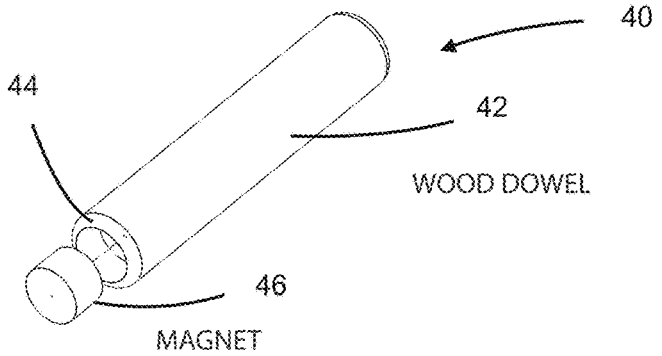

An aesthetic substrate 32, which can be a pictorial print, e.g., photograph, printed on a foam core or plastic for example, has one or more metallic magnetically attracted member 34 on a back 36 of the substrate 32 oriented in a complementary manner to be magnetically held in place by the magnets 26 of the panel 20. Preferably, the aesthetic substrate can be configured substantially to the area A to render a gapless appearance within the picture frame system. It is noted that the number of magnets 26, and or size, is preferably configured to maintain the substrate 32 in a secure and relatively flat manner against the panel 20. It is contemplated that the metallic magnetically attracted member 34 can be oriented as seen in FIG. 1 or 5, or optionally extend throughout the back surface 36 of the substrate 32. The picture frame system 10 envisions a peripheral member(s) 14 having various geometric configurations, such as rectangular, annular, or polygonal shaped body wherein the substrate 32 is configured to span within area A in a manner to span the entire area A of panel 20 providing a gap free visual effect.

Thus, the picture frame system 10 has interchangeable panel members 32 magnetically held within a defined inner panel area A enabling quick removal and replacement and for displaying two and/or three dimensional artwork, pictorial print and photography. In the case of 3-dimensional art, it is envisioned that an object which could be a figurine, for example, having a base configured with magnetic member to connect to substrate 32.

A 3-dimensional substrate removal tool 40 is available which could be in the form of the figurine or simply a handle. The removal tool 40 includes a handle member 42 having one end 44 equipped with a magnet 46, preferably having a greater magnetic force than the magnetic force of that in the panel 20, and upon contact with a part of the substrate 32 having the metallic magnetically attracted member 34 therebehind, the substrate 32 can be quickly removed without the need of removing the frame 12 from the wall to which it is fixed.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A picture frame system, comprising:

at least one frame including at least one perimeter member of a thickness T and having an inner surface defining a channel;

a removable panel member having a peripheral edge received in said channel, said removable panel member defining an exposed area within said perimeter member:

at least one magnetic member attached to said panel member and located at least partially behind said exposed area; and a substrate having an aesthetic aspect on a front and at least one metallic magnetically attracted member on a back, said metallic magnetically attracted member positioned to align in complementary registry with said at least one magnetic member on said removable panel member such that said substrate is removably and magnetically held in place within said exposed area, wherein said removable panel member is further characterized such that said at least one magnet member includes a plurality of peripherally disposed magnets placed within a plurality of open surfaces, each said open surface defined within a surface of said removable panel member of a size to friction fit and retain one of each said magnets.

2. The picture frame system of claim 1, wherein said substrate is configured to substantially span within said exposed area to render a gapless appearance within said picture frame system.

3. The picture frame system of claim 1, wherein substrate includes a pictorial print on one of a semi rigid and rigid substrate.

4. The picture frame system of claim 1, wherein the magnets are positioned adjacent to and along a peripheral boundary of said removable panel member.

5. The picture frame system of claim 1, wherein said magnets are arranged in a peripheral pattern on a rear surface of said removable panel member.

6. The picture frame system of claim 1, which includes a wall mounting structure on a back of said perimeter member.

7. A picture frame system, comprising:

at least one frame including at least one perimeter member of a thickness T and having an inner surface defining a channel;

a removable panel member having a peripheral edge received in said channel, said removable panel member defining an exposed area within said perimeter member:

at least one magnetic member attached to said panel member and located at least partially behind said exposed area; and a substrate having an aesthetic aspect on a front and at least one metallic magnetically attracted member on a back, said metallic magnetically attracted member positioned to align in complementary registry with said at least one magnetic member on said removable panel member such that said substrate is removably and magnetically held in place within said exposed area further comprising a 3-dimensional removal tool having a magnet at one end having a greater magnetic force than said magnetic member on said removable panel member, such that said removal tool can engage said metallic member on said substrate to remove said substrate from said removable panel member without detaching said frame from a mounting surface.

8. The picture frame system of claim 7, wherein said substrate is configured to substantially span within said exposed area to render a gapless appearance within said picture frame system.

9. The picture frame system of claim 7, wherein substrate includes a pictorial print on one of a semi rigid and rigid substrate.

10. The picture frame system of claim 7, which includes a wall mounting structure on a back of said perimeter member.

11. The picture frame system of claim 7, wherein said removable panel member is further characterized such that said at least one magnet member includes a plurality of peripherally disposed magnets placed within a plurality of open surfaces, each said open surface defined within a surface of said removable panel member of a size to friction fit and retain one of each said magnets.

12. The picture frame system of claim 11, wherein the magnets are positioned adjacent to and along a peripheral boundary of said removable panel member.

13. The picture frame system of claim 11, wherein said magnets are arranged in a peripheral pattern on a rear surface of said removable panel member.

* * * * *